US010176962B2

(12) United States Patent
Setzer et al.

(10) Patent No.: US 10,176,962 B2
(45) Date of Patent: Jan. 8, 2019

(54) X-RAY EMITTER

(71) Applicant: SIEMENS HEALTHCARE GMBH, Erlangen (DE)

(72) Inventors: Stefan Setzer, Fuerth (DE); Stephan Sons, Bubenreuth (DE)

(73) Assignee: Siemens Healthcare GmbH, Erlangen (DE)

( * ) Notice: Subject to any disclaimer, the term of this patent is extended or adjusted under 35 U.S.C. 154(b) by 173 days.

(21) Appl. No.: 15/240,050

(22) Filed: Aug. 18, 2016

(65) Prior Publication Data

US 2017/0053769 A1 Feb. 23, 2017

(30) Foreign Application Priority Data

Aug. 18, 2015 (DE) ..... 10 2015 215 689

(51) Int. Cl.

| | |
|---|---|
| ***H05G 1/10*** | (2006.01) |
| ***H01J 35/06*** | (2006.01) |
| ***H05G 1/12*** | (2006.01) |
| ***H05G 1/34*** | (2006.01) |
| ***H01J 35/08*** | (2006.01) |

(52) U.S. Cl.

CPC ..... *H01J 35/06* (2013.01); *H01J 35/08* (2013.01); *H05G 1/12* (2013.01); *H05G 1/34* (2013.01)

(58) Field of Classification Search

None

See application file for complete search history.

(56) References Cited

U.S. PATENT DOCUMENTS

| | | | | |
|---|---|---|---|---|
| 5,034,973 | A * | 7/1991 | Ishiyama | H05G 1/10 363/16 |
| 7,864,925 | B2 | 1/2011 | Kutschera | |
| 2008/0170667 | A1* | 7/2008 | Ernest | H05G 1/10 378/101 |
| 2011/0150187 | A1 | 6/2011 | Boudry et al. | |
| 2012/0121069 | A1 | 5/2012 | Aoki et al. | |
| 2012/0189103 | A1 | 7/2012 | Duhamel | |
| 2015/0163890 | A1 | 6/2015 | Setzer et al. | |

FOREIGN PATENT DOCUMENTS

| | | | |
|---|---|---|---|
| CN | 104717816 | A | 6/2015 |
| DE | 19914739 | C1 | 8/2000 |
| DE | 19955845 | A1 | 5/2001 |
| DE | 102008011841 | A1 | 10/2009 |
| DE | 102013225589 | A1 | 6/2015 |
| WO | 2010070583 | A1 | 6/2010 |

* cited by examiner

*Primary Examiner* — Hoon Song

(74) *Attorney, Agent, or Firm* — Laurence Greenberg; Werner Stemer; Ralph Locher

(57) ABSTRACT

An X-ray emitter has an X-ray tube which contains a vacuum envelope in which an emitter and an anode are disposed. The emitter can be heated by an external flat emitter filament supply. Accordingly the emitter is configured as a filament emitter and an interface circuit is arranged between the filament emitter and the flat emitter filament supply. In this manner, a flat-emitter-based X-ray emitter can be replaced by a filament-emitter-based X-ray emitter in an X-ray emitter system without any configuration changes.

8 Claims, 3 Drawing Sheets

X-RAY EMITTER

CROSS-REFERENCE TO RELATED APPLICATION

This application claims the priority, under 35 U.S.C. § 119, of German application DE 10 2015 215 689.3, filed Aug. 18, 2015; the prior application is herewith incorporated by reference in its entirety.

BACKGROUND OF THE INVENTION

Field of the Invention

The invention relates to an X-ray emitter.

Such an X-ray emitter contains an X-ray tube with a vacuum envelope in which an emitter and an anode are arranged, wherein the emitter can be heated by an external flat emitter filament supply.

A cathode with a filament emitter (corded filament) is known for example from published, non-prosecuted German patent application DE 199 55 845 A1.

Cathodes that have flat emitters are described for example in German patent DE 199 14 739 C1 and in published, non-prosecuted German patent DE 10 2008 011 841 A1, corresponding to U.S. Pat. No. 7,864,925.

Compared to a flat emitter, in a filament emitter the effects of changes in the emission current onto the focal spot are less. Therefore the focal spot is sufficiently constant even in the case of a less stable emission current. In addition, a filament emitter is simpler and thus less expensive to manufacture than a flat emitter. However, in the case of comparable heat outputs a filament emitter needs a filament voltage two to three times higher compared to a flat emitter, at the same time as a small filament current.

In X-ray emitter systems the heat output is provided by a filament current injected into the emitter, with switching transformers or linear controllers typically being used for this purpose, which depending on the configuration can supply a predefined maximum filament voltage. It is therefore not straightforwardly possible simply to replace a flat-emitter-based X-ray emitter (where the X-ray emitter contains an X-ray tube with a flat emitter) by a filament-emitter-based X-ray emitter (where the X-ray emitter contains an X-ray tube with a filament emitter). Modifying the flat emitter filament supply for use in a filament-emitter-based X-ray emitter requires a considerable effort on the system side and results in increased complexity, since there is no longer any mandatory backward compatibility. X-ray emitter systems are therefore typically configured either exclusively for flat-emitter-based X-ray emitters or exclusively for filament-emitter-based X-ray emitters.

Furthermore, in published, non-prosecuted German patent DE 10 2013 225 589 A1 (corresponding to U.S. patent publication No. 2015/0163890) an X-ray emitter with a flat emitter is disclosed, which can be replaced by an existing filament-emitter-based X-ray emitter without any design changes to an X-ray emitter system.

SUMMARY OF THE INVENTION

The object of the present invention is therefore to create a filament-emitter-based X-ray emitter which can be replaced by an existing flat-emitter-based X-ray emitter without any design changes to an X-ray emitter system.

The X-ray emitter according to the invention contains an X-ray tube with a vacuum envelope in which an emitter and an anode are arranged, wherein the emitter can be heated by an external flat emitter filament supply. According to the invention the emitter is configured as a filament emitter and an interface circuit is arranged between the filament emitter and the flat emitter filament supply.

Because according to the invention an interface circuit is arranged between the filament emitter and the flat emitter filament supply, the limitation of the filament voltage in the flat emitter filament supply is easily avoided.

The inventively provided interface circuit can for example be integrated into the X-ray emitter or be embodied as an external assembly which is arranged between the filament emitter and the flat emitter filament supply. Since the heat outputs in filament emitters and flat emitters lie in the same order of magnitude an impedance transformation is sufficient at this point.

By using the inventively provided interface circuit it is possible to replace flat-emitter-based X-ray emitters by filament-emitter-based X-ray emitters without any modifications to the X-ray emitter system ("drop-in replacement"). This means the advantages of filament emitter technology can also be easily realized in the case of X-ray emitter systems with flat-emitter-based X-ray emitters.

Depending on the structure of the flat emitter filament supply various advantageous variants can be implemented for the interface circuit, which is part of the X-ray emitter.

An advantageous embodiment is characterized in that the interface circuit is configured as a passive impedance transformer.

In a further preferred embodiment the interface circuit is designed as an active impedance transformer.

In an embodiment of the X-ray emitter the flat emitter filament supply provides a filament current and the interface circuit contains at least one transformer which is connected to the flat emitter filament supply on the primary side and to the filament emitter on the secondary side. Because it is configured as a transformer the passive impedance transformer has a particularly simple structure in terms of design.

Advantageous exemplary embodiments of the X-ray emitters teach that the interface circuit is embodied as an active impedance transformer.

According to a preferred embodiment the flat emitter filament supply provides an alternating current and the interface circuit contains a rectifier arrangement, a series-connected low-pass filter and an impedance transformation unit with at least one DC-DC converter. The rectifier arrangement is connected to the flat emitter filament supply and the impedance transformation unit is connected to the filament emitter. A DC-DC converter means a direct voltage converter, e.g. in the form of a clocked power supply.

In a further advantageous embodiment the flat emitter filament supply provides a rectified alternating current and the interface circuit contains a low-pass filter and an impedance transformation unit with at least one DC-DC converter. The low-pass filter is connected to the flat emitter filament supply and the impedance transformation unit is connected to the filament emitter.

In a likewise advantageous embodiment the flat emitter filament supply provides a direct current and the interface circuit contains an impedance transformation unit with at least one DC-DC converter, which is connected to the flat emitter filament supply on the input side and to the filament emitter on the output side.

In a preferred exemplary embodiment the flat emitter filament supply provides an alternating current and the interface circuit contains a transformer, a rectifier arrangement and a series-connected low-pass filter. The transformer is connected to the flat emitter filament supply on the primary side and to the rectifier arrangement on the secondary side, and the low-pass filter is connected to the filament emitter. This therefore involves a variant of the interface circuit which comprises a transformer and a rectifier arrangement with a low-pass filter, but no DC-DC converter.

Other features which are considered as characteristic for the invention are set forth in the appended claims.

Although the invention is illustrated and described herein as embodied in an X-ray emitter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
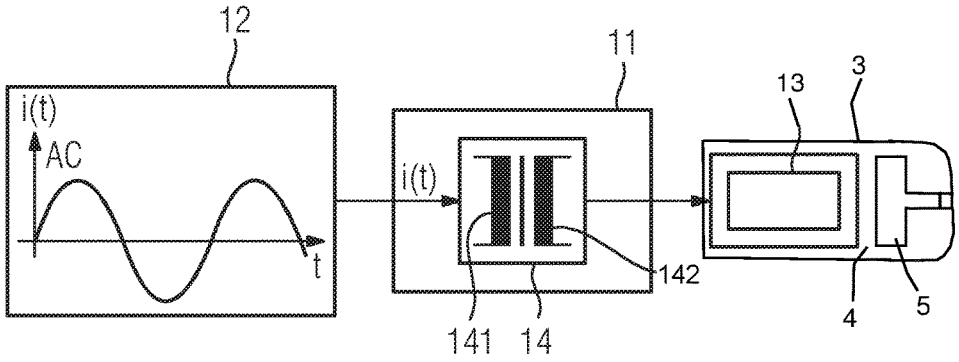
FIG. 1 is an illustration showing an interface circuit according to a first embodiment of an X-ray emitter according to the invention.

Referring now to the figures of the drawings in detail and first, particularly to FIG. 1 thereof, there is shown an exemplary embodiment of an X-ray emitter which contains an interface circuit 11 which is inventively arranged between an external flat emitter filament supply 12 and a filament emitter 13. The X-ray emitter according to the invention contains an X-ray tube 3 with a vacuum envelope 4 in which the emitter 13 and an anode 5 are arranged.

The flat emitter filament supply 12 provides an alternating current $i_{AC}(t)$. The interface circuit 11 is configured as a passive impedance transformer and in the illustrated exemplary embodiment contains a transformer 14 with a primary winding 141 and a secondary winding 142. The transformer 14 is connected to the flat emitter filament supply 12 on the primary side and to the filament emitter 13 on the secondary side. The filament emitter 13 is thereby supplied with alternating current.

Figure 2:
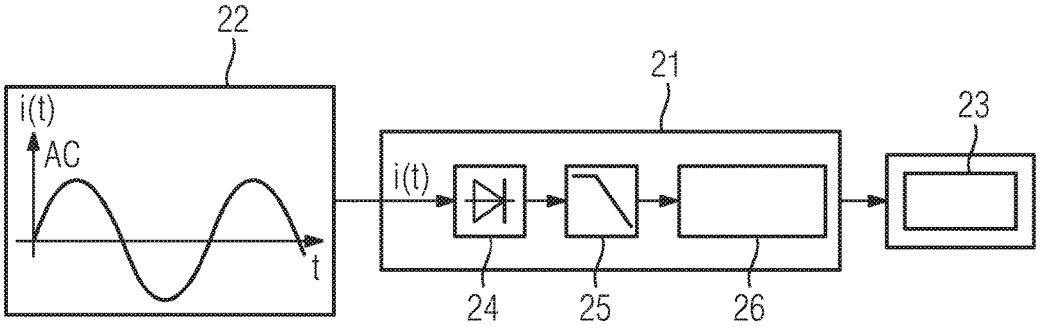
FIG. 2 is an illustration showing the interface circuit according to a second embodiment of the X-ray emitter.

The embodiment of an X-ray emitter illustrated in FIG. 2 contains an interface circuit 21 which is inventively arranged between an external flat emitter filament supply 22 and a filament emitter 23.

The flat emitter filament supply 22 provides an alternating current $i_{AC}(t)$. The interface circuit 21 is configured as an active impedance transformer and in the illustrated exemplary embodiment contains a rectifier arrangement 24, a series-connected low-pass filter 25 and an impedance transformation unit 26 with at least one DC-DC converter. The rectifier arrangement is connected to the flat emitter filament supply 22 and the impedance transformation unit 26 is connected to the filament emitter 23. The filament emitter 23 is thereby supplied with direct current.

Figure 3:
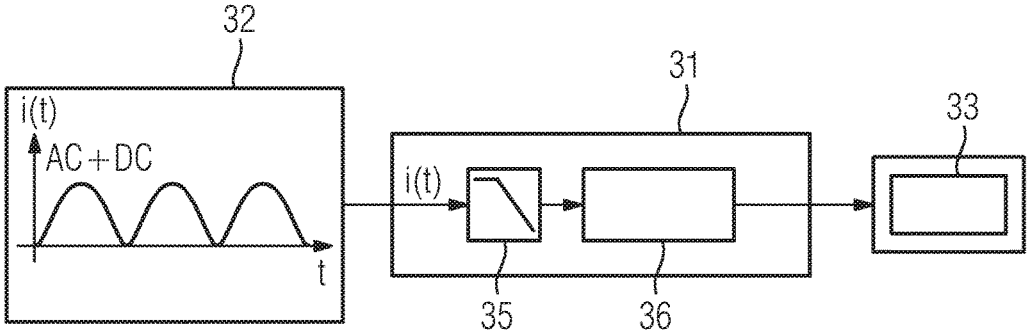
FIG. 3 is an illustration showing the interface circuit according to a third embodiment of the X-ray emitter.

FIG. 3 shows an embodiment of an X-ray emitter which contains an interface circuit 31 which is inventively arranged between an external flat emitter filament supply 32 and a filament emitter 33.

The flat emitter filament supply 32 provides a rectified alternating current $i_{AC+DC}(t)$. The interface circuit 31 is configured as an active impedance transformer and in the illustrated exemplary embodiment contains a low-pass filter 35 and an impedance transformation unit 36 with at least one DC-DC converter. The low-pass filter 35 is connected to the flat emitter filament supply 32 and the impedance transformation unit 36 is connected to the filament emitter 33. The filament emitter 33 is thereby supplied with direct current.

Figure 4:
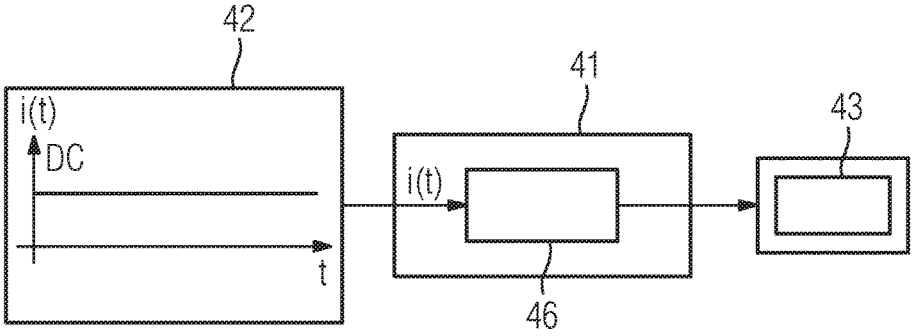
FIG. 4 is an illustration showing the interface circuit according to a fourth embodiment of the X-ray emitter.

The embodiment of an X-ray emitter illustrated in FIG. 4 contains an interface circuit 41 which is inventively arranged between an external flat emitter filament supply 42 and a filament emitter 43.

The flat emitter filament supply 42 provides a direct current $i_{DC}(t)$. The interface circuit 41 is configured as an active impedance transformer and in the illustrated exemplary embodiment contains an impedance transformation unit 46 with at least one DC-DC converter. The impedance transformation unit 46 is connected to the flat emitter filament supply 42 on the input side and to the filament emitter 43 on the output side. The filament emitter 43 is thereby supplied with direct current.

Figure 5:
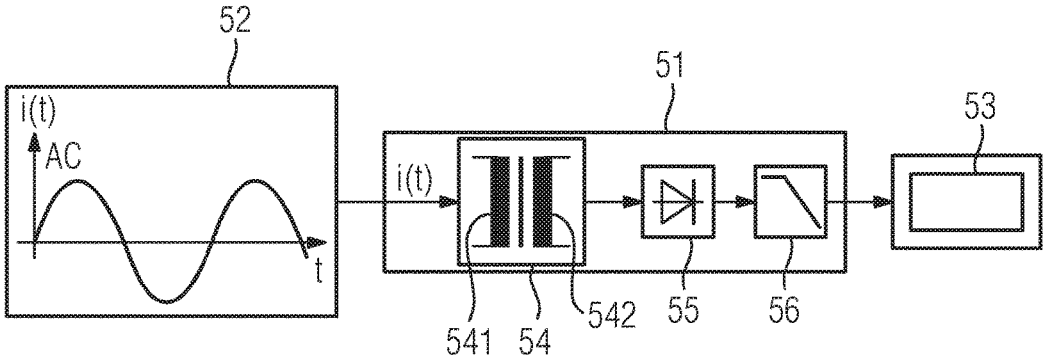
FIG. 5 is an illustration showing the interface circuit according to a fifth embodiment of the X-ray emitter.

The exemplary embodiment of an X-ray emitter illustrated in FIG. 5 contains an interface circuit 51 which is inventively arranged between an external flat emitter filament supply 52 and a filament emitter 53.

The flat emitter filament supply 52 provides an alternating current $i_{AC}(t)$. The interface circuit 51 is configured as an active impedance transformer and in the illustrated embodiment contains a transformer 54 with a primary winding 541 and a secondary winding 542. Furthermore, the interface circuit 51 contains a rectifier arrangement 55 and a series-connected low-pass filter 56. The transformer 54 is connected to the flat emitter filament supply 52 on the primary side and to the rectifier arrangement 55 on the secondary side. The low-pass filter 56 is connected to the filament emitter 53. The filament emitter 53 is thereby supplied with direct current.

In the embodiments described in FIG. 1 to FIG. 5 the filament emitters are supplied with either alternating current (FIG. 1) or direct current (FIG. 2 to FIG. 5) as filament current. This means a magnetic field is always generated in the region of the emitting surface of the filament emitter. This magnetic field deflects the electrons and can thereby impact negatively on the achievable focal spot quality.

In the case of a supply of alternating current (FIG. 1) the electrons are deflected maximally in each case in a positive and negative direction within a period, whereas in the case of a supply of direct current (FIG. 2 to FIG. 5) only a static deflection of the electrons occurs, which however is easier to control compared to a supply of alternating current and thus provides better focal spot qualities.

The invention described on the basis of the illustrated exemplary embodiments can advantageously be realized for a plurality of X-ray emitters and is therefore suitable for a plurality of X-ray emitter systems.

Thanks to the inventive solution a flat-emitter-based X-ray emitter can be replaced by a filament-emitter-based X-ray emitter in an X-ray emitter system without any design changes.

Although the invention is illustrated and described in more detail by preferred exemplary embodiments, the invention is not restricted by the exemplary embodiment shown in the drawing. Instead, other variants of the inventive solution can also be derived herefrom by the person skilled in the art, without herewith departing from the underlying inventive idea, for arranging an interface circuit between the filament emitter and the flat emitter filament supply.

The invention claimed is:

1. An X-ray emitter, comprising:

an X-ray tube having a vacuum envelope;

an emitter disposed in said X-ray tube and configured as a filament emitter or as a flat emitter;

an anode disposed in said X-ray tube;

an external flat emitter filament supply for heating said emitter being either said filament emitter or said flat emitter; and an interface circuit connected between said emitter and said flat emitter filament supply, said interface circuit providing a first voltage level to said filament emitter when operating with said filament emitter and said external flat emitter filament supply supplying a second voltage level to said flat emitter when operating with said flat emitter.

2. The X-ray emitter according to claim 1, wherein said interface circuit is a passive impedance transformer.

3. The X-ray emitter according to claim 1, wherein said interface circuit is an active impedance transformer.

4. The X-ray emitter according to claim 2, wherein:

said external flat emitter filament supply outputs an alternating current; and said interface circuit contains at least one transformer which is connected to said external flat emitter filament supply on a primary side and to said filament emitter on a secondary side.

5. The X-ray emitter according to claim 3, wherein:

said external flat emitter filament supply outputs an alternating current; and said interface circuit has a rectifier configuration, a series-connected low-pass filter and an impedance transformation unit with at least one DC-DC converter, said rectifier configuration is connected to said external flat emitter filament supply and said impedance transformation unit is connected to said filament emitter.

6. The X-ray emitter according to claim 3, wherein:

said external flat emitter filament supply outputs a rectified alternating current; and said interface circuit has a low-pass filter and an impedance transformation unit with at least one DC-DC converter, said low-pass filter is connected to said external flat emitter filament supply and said impedance transformation unit is connected to said filament emitter.

7. The X-ray emitter according to claim 3, wherein:

said external flat emitter filament supply outputs a direct current; and said interface circuit has an impedance transformation unit with at least one DC-DC converter which is connected to said external flat emitter filament supply on an input side and to said filament emitter on an output side.

8. The X-ray emitter according to claim 3, wherein:

said external flat emitter filament supply outputs an alternating current; and said interface circuit contains a transformer, a rectifier configuration and a series-connected low-pass filter, said transformer is connected to said external flat emitter filament supply on a primary side and to said rectifier configuration on a secondary side and said low-pass filter is connected to said filament emitter.

* * * * *